US005947344A

United States Patent [19]

Jangaard

[11] Patent Number: 5,947,344

[45] Date of Patent: Sep. 7, 1999

[54] CONTAINER AND METHOD FOR DISPENSING MOTOR OIL AND OTHER LIQUIDS

[76] Inventor: Stephen S. Jangaard, 5221 W. Carson St., Torrance, Calif. 90503

[21] Appl. No.: 08/978,506

[22] Filed: Nov. 25, 1997

[51] Int. Cl.[6] ..... B65D 37/00

[52] U.S. Cl. ..... 222/494; 222/212

[58] Field of Search ..... 222/491, 494, 222/212; 141/114

[56] References Cited

U.S. PATENT DOCUMENTS

| | | | |
|---|---|---|---|
| 1,735,784 | 11/1929 | Olson . | |
| 2,018,552 | 10/1935 | Grammar et al. . | |
| 2,482,384 | 9/1949 | Tullgren et al. . | |
| 2,755,974 | 7/1956 | Godfrey . | |
| 2,957,609 | 10/1960 | Holmes . | |
| 3,141,579 | 7/1964 | Medlock . | |
| 3,146,919 | 9/1964 | Chappell . | |
| 3,179,300 | 4/1965 | Davidson et al. . | |
| 3,184,121 | 5/1965 | Volckening . | |
| 3,207,374 | 9/1965 | Holmes et al. . | |
| 3,456,650 | 7/1969 | Schwartzman | 222/212 X |
| 3,756,460 | 9/1973 | Hill . | |
| 4,022,351 | 5/1977 | Wright . | |
| 4,162,749 | 7/1979 | Bennett . | |
| 4,949,857 | 8/1990 | Russell | 222/212 X |
| 5,000,353 | 3/1991 | Kostanecki et al. . | |
| 5,133,479 | 7/1992 | Boyte, Sr. . | |
| 5,249,714 | 10/1993 | Merhar . | |
| 5,259,535 | 11/1993 | Boyte, Sr. . | |
| 5,370,266 | 12/1994 | Woodruff | 222/212 X |

FOREIGN PATENT DOCUMENTS

| | | | |
|---|---|---|---|
| WO 88/06129 | 8/1988 | WIPO | B65D 47/20 |

*Primary Examiner*—Andres Kashnikow
*Assistant Examiner*—Sean P. O'Hanlon
*Attorney, Agent, or Firm*—Oppenheimer Wolff & Donnelly LLP

[57] ABSTRACT

A spill-proof motor oil bottle has a neck and a fluid reservoir with flexible sides. The neck has a first narrow portion, a relatively wider chamber adjacent to the first narrow portion, and a second narrow portion adjacent to the chamber. The bottle has a fluid flow path defined from the fluid reservoir through the first narrow portion, the chamber and the second narrow portion. The fluid flow path interconnects the two narrow portions and the chamber. A flexible plug, which is usually made of a compressible closed cell material, is compressed by and lodged within the first narrow portion to block the fluid flow path. The plug is adapted to dislodge from the first narrow portion into the chamber to open the fluid flow path when motor oil in the fluid reservoir displaces toward the neck of the bottle in response to a user squeezing the sides of the fluid reservoir. A method of dispensing a liquid with the bottle includes turning the container upside down, inserting at least a portion of the neck of the bottle into an engine opening into which the motor oil is to flow, and then squeezing the flexible portion of the fluid reservoir to dislodge the plug from the first narrow portion of the neck and into the chamber, thereby opening the fluid flow path so that oil flows out of the bottle and into the motor.

15 Claims, 2 Drawing Sheets

CONTAINER AND METHOD FOR DISPENSING MOTOR OIL AND OTHER LIQUIDS

I. BACKGROUND OF THE INVENTION

A. Related Patent

The present patent application is related to U.S. Pat. No. 5,472,123, which issued to the present inventor on Dec. 5, 1995, and which is incorporated by reference herein.

B. Field of the Invention

The present invention relates to containers for dispensing fluids and, in particular, to a bottle for dispensing motor oil that prevents the oil from dispensing prematurely.

C. Prior Art

U.S. Pat. No. 5,259,535, issued to James Boyte, discloses a bottle having a buoyant, invertable stopper that is heavier toward one end. When the user squeezes and inverts the bottle, the stopper prevents oil from flowing through the neck of the bottle. However, when the user stops squeezing the bottle, the buoyant stopper floats away from the neck of the bottle, thereby permitting oil to float through the neck of the bottle. U.S. Pat. No. 5,370,266, issued to James Woodruff, discloses a similar arrangement.

U.S. Pat. No. 2,018,552, issued to A. L. Grammar, discloses a powder dispensing container. The container has a neck having a discharge opening and a guide portion. A closure that is connected to a rigid shaft normally blocks the discharge opening. The rigid shaft is connected to bottom wall of the container. In use, the user flexes the bottom wall, thereby pushing the rigid shaft and the connected closure. The closure moves out of the discharge opening, permitting powder to flow through the opening. When the user releases the wall, the the closure again blocks the discharge opening.

U.S. Pat. No. 5,472,123, issued to the present inventor, discloses a bottle having a flexible flap valve with an edge and a blocking portion that are disposed within the neck of the bottle. The valve has a closed position in which the flap edge is releasably disposed within a retention groove and in which the blocking portion prevents fluid from flowing through the neck of the bottle. The valve also has an open position in which the flap edge is disengaged from the retention groove so that fluid may flow through the neck of the bottle. While this approach represents a significant improvement over the prior art, it is desirable to find an alternative design that costs less to manufacture.

II. SUMMARY OF THE INVENTION

The object of the present invention is to overcome the deficiencies in the prior art. Accordingly, an embodiment of the present invention is a spill-proof container for fluids has a neck and a fluid reservoir with flexible sides. The neck has a narrow portion and a relatively wider portion adjacent to the narrow portion. A fluid flow path is defined through the narrow portion and through the relatively wider portion. A plug having a compressible portion is lodged in the narrow portion of the container to block the fluid flow path. The flexible plug is adapted to dislodge from the narrow portion of the container to the relatively wider portion to open the fluid flow path when pressure is applied to the plug from within the bottle in response to a user squeezing the flexible sides.

Different embodiments of the present invention may incorporate any of a number of features. The plug can be made from a closed cell foam so that fluid will not flow through the plug itself. The narrow portion can be a first narrow portion, and the neck can have a second narrow portion. The wider portion is then in between the two narrow portions, with the second narrow portion preventing the plug from exiting from the wider portion once the plug has been dislodged from the first narrow portion. The relatively wider portion can be a chamber. The neck can include a finger extending into the neck to retain said plug within the neck. The narrow portion of the neck can hold the plug in place by compressing a portion of the flexible material when the plug is lodged in the narrow portion.

The present invention extends to a method of dispensing a liquid. The first step is to provide one of the various embodiments of a container according to the present invention, the container having been at least partially filled with a liquid. The container is inverted such that the neck is generally below the fluid reservoir. At least a portion of the neck of the container is inserted into an opening into which the fluid is to flow. After that, the user squeezes at least one flexible side of the fluid reservoir to displace the liquid toward and against the neck, thereby dislodging the plug from the narrow portion of the neck and thereby opening the fluid flow path so that the fluid can flow through the neck.

While the above summarizes features of the invention, the invention includes various other aspects and objects. Reference should be made to the drawings that accompany this application and to the detailed description of the preferred embodiment provided below.

III. BRIEF DESCRIPTION OF THE DRAWINGS

Figure 1:
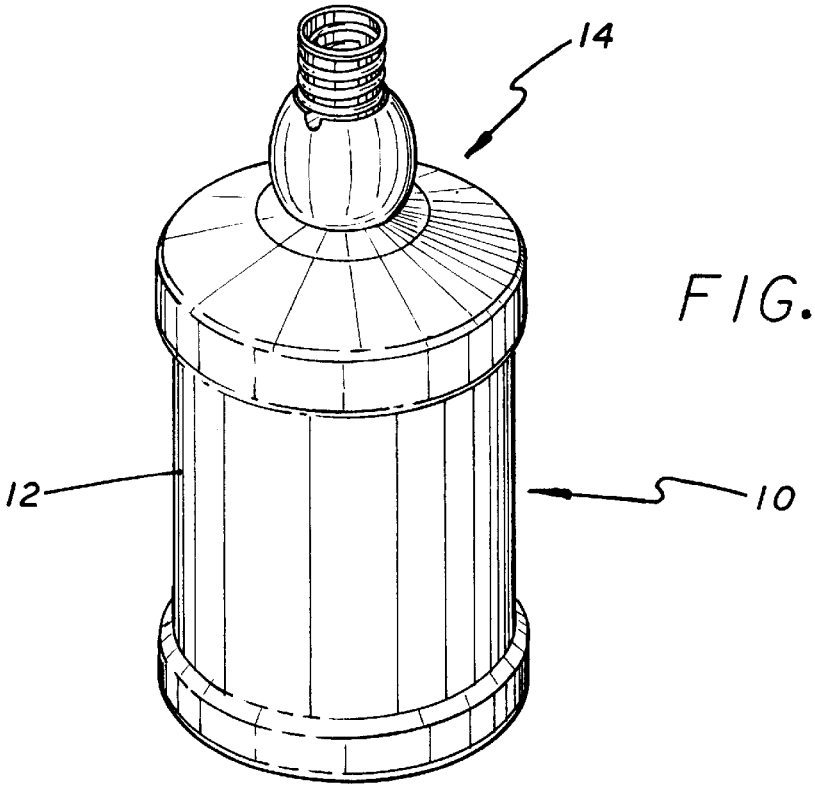
FIG. 1 is a perspective view of a container according to the present invention.
Figure 3:
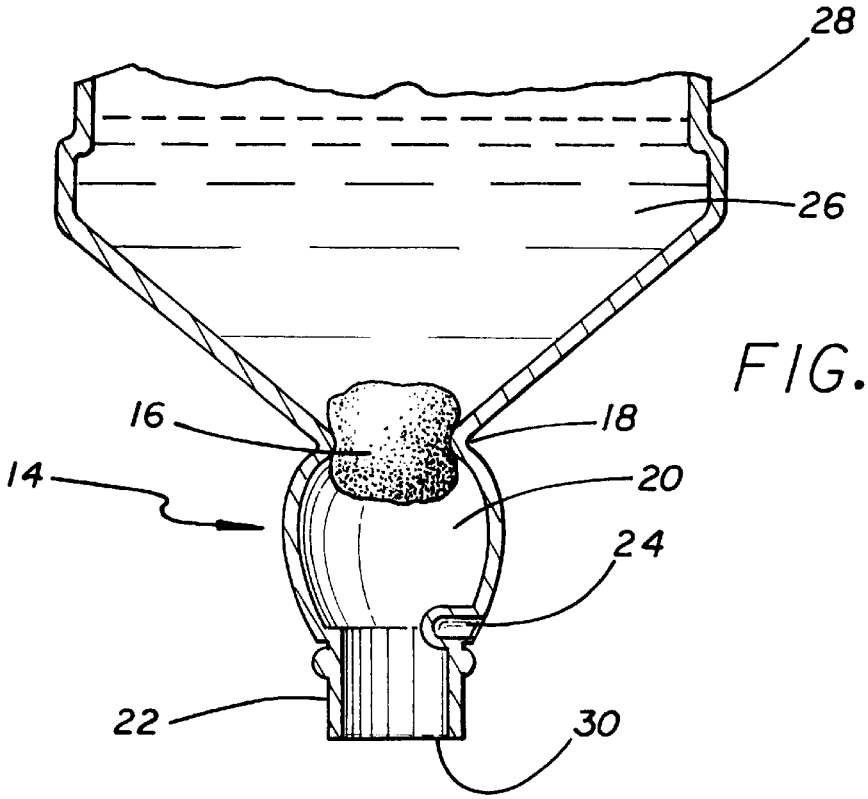
Figure 4:
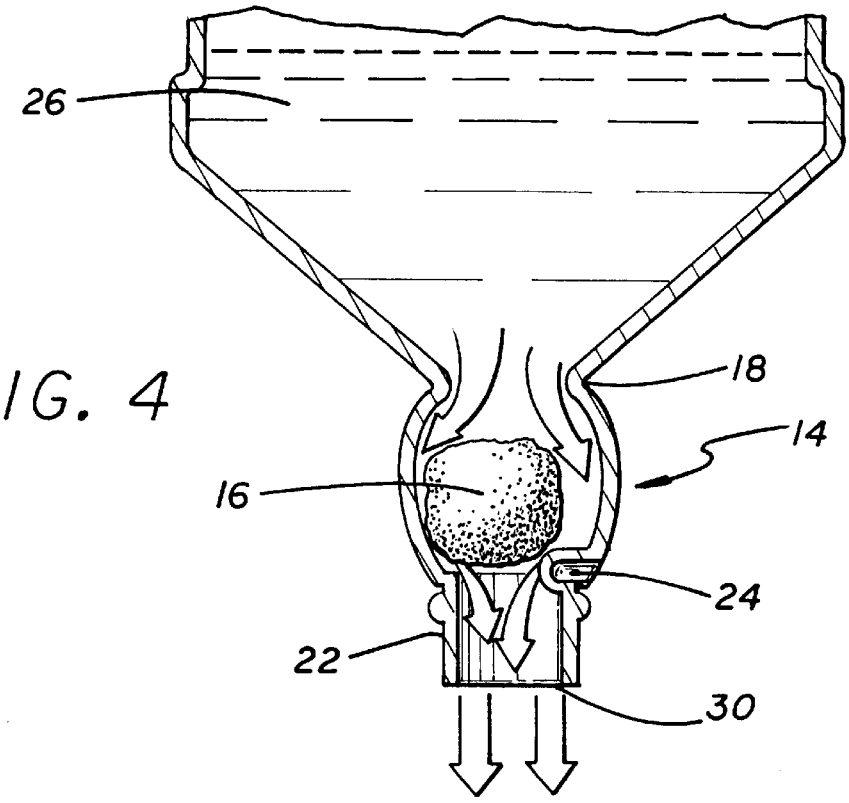

FIG. 3 is a cross-sectional view taken through the neck of the container of FIG. 1, illustrating the plug lodged in the narrow portion of the neck; and FIG. 4 is a cross-section view taken through the neck of the container of FIG. 1, illustrating the plug within the plug retention chamber after the user has squeezed the sides of the container to dislodge the plug from the narrow portion at the base of the neck.

IV. DETAILED DESCRIPTION OF THE PREFERRED EMBODIMENT

Referring to the embodiment of FIG. 1, the present invention is a container 10 for fluids that retains the fluid within the container, even when the container is turned upside down, until the user squeezes the sides 12 of the container to open a valve that is generally located in the neck 14 of the container. The valve includes a compressible plug 16, a narrow opening 18 at the base of the neck of the bottle, a plug retention chamber 20, a second narrow opening 22 at the end of the neck and a retention pin 24 at the junction between the chamber 20 and the second narrow opening 22.

In the presently preferred embodiment, the container 10 is initially filled with motor oil 26 in a fluid reservoir 28. The user can turn the container 10 upside down as in FIG. 3, and the plug 16, which is initially lodged in the narrow opening 18 of the neck, prevents oil from flowing through the neck. In the embodiment of FIG. 3, the plug 16 is made of a compressible material such as a resilient closed cell foam. When the plug 16 is placed in the narrow opening 18, a portion of the plug 16 compresses and becomes lodged within the narrow opening 18.

The container 10 is preferably blow-molded from a flexible plastic, such as polyethelene. The sides 12 of the container are then flexible, so that when the container 10 is filled with oil 26, the user can displace the oil toward the neck 14. As the oil displaces toward the neck, the oil pushes against the plug 16. By squeezing the flexible sides of the container 10, the user can displace the oil to an extent sufficient to dislodge the plug 16 from the narrow opening 18. The displacement of the oil pushes the plug 16 into the plug retention chamber 20, which has width, depth and length greater than the plug 16. Consequently, when the oil pushes the plug 16 into the chamber 20, there is space about the plug 16 through which the oil can flow. FIG. 4 illustrates a fluid flow path in which fluid flows from the fluid reservoir 28, through the narrow opening 18 at the base of the neck, around the plug 16 in the chamber 20, through the second narrow portion 22 and out the container at the container opening 30.

Figure 2:
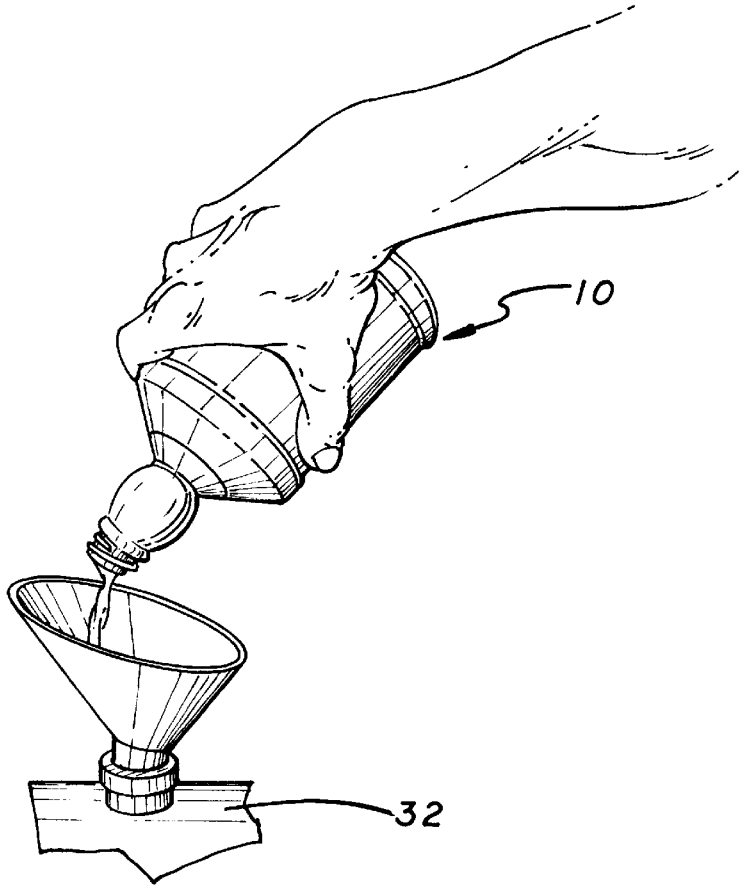
FIG. 2 illustrates the container of FIG. 1 as it appears in use, after the user has squeezed the flexible sides of the container to dislodge the plug from the narrow portion at the base of the neck of the container.

Once the plug enters the chamber 20, the geometry of the chamber prevents the plug from escaping the chamber. If the plug were to exit the mouth 30 of the container and fall into the crankcase 32 of an automobile (FIG. 2), for instance, the automobile engine could be ruined. Consequently, in embodiments of the present invention that are to be used to pour motor oil into engines, it is critical that the plug 16 not escape the chamber 20 and flow out of the container with the oil. For this reason, the neck 14 is provided with a retention pin 24 that extends inwardly into the neck of the container at the junction between the chamber 20 and the second narrow portion 22. The retention pin 24 is a physical barrier that prevents the plug from escaping the chamber 20. The pin has a relatively narrow diameter, so that it does not significantly impede the flow of oil out of the neck.

The presently preferred embodiment of the container has the following dimensions, which are by way of illustration and not limitation. The first and second narrow portions 18, 22 have diameters of approximately 1 inch. The fluid reservoir 28 is typically generally cylindrical and has a volume of approximately 1 quart. The plug 16 has a diameter slightly larger than that of the first narrow portion, so that the plug will compress somewhat when engaged with the first narrow portion. The chamber 20 has a diameter of approximately 1 ¾ inches at the widest point. Of course, these specifications relate solely to one embodiment of the invention, and other embodiments can have different specifications. For example, the bottle need not be cylindrical, but can be any geometry suitable for the application for which the bottle is to be used.

The presently preferred embodiment is made by blow molding a polymer, such as polyethelene, as is conventional within the oil bottle art. The plug 16 is typically polyethylene foam, although other closed cell materials can be used.

The embodiment of the present invention that the figures illustrate is just one embodiment of the invention. Numerous design changes are possible within the scope of the invention. For example, the pin 24 prevents the plug 16 from escaping the chamber 20. However, the pin is not necessary since, for example, the diameter of the second narrow portion 22 can be made narrow enough so that the plug 16 cannot escape the container even without the use of a retention pin 24. Alternatively, the bottle may be provided with more than one pin to retain the plug within the neck of the bottle. The pin or pins may be designed to hold the plug off to one side of the chamber. As another variation, the plug 16 can be made of a relatively incompressible material, such as rubber, and can be held in place within the narrow portion 18 with friction. Of course, the container can hold any of a wide variety of fluids other than motor oil.

The chamber 20 is illustrated as having a generally circular cross section. However, the chamber can have other geometries, so long as a fluid flow path is established through the chamber when the plug 16 occupies the chamber. For example, in particular applications the manufacturer may wish to make the chamber 20 in an octagonal or other shape for aesthetic reasons.

The invention can be further extended to other applications beyond oil containers. For instance, a chemist may wish to keep two liquids separate from one another until she wishes to mix them. A container can be devised having two separate fluid reservoirs that are interconnected by a valve having the same general components as the neck 14 of the container that FIGS. 1–4 illustrate. That is, a flexible, compressible plug can block a narrow portion of the neck as FIG. 3 illustrates. The second narrow portion 22 can open into a second fluid reservoir, instead of opening to the exterior of the container. When the chemist wishes to mix the separate compounds that are stored in the separate fluid reservoirs, she squeezes the flexible walls of a fluid reservoir to dislodge the plug into the chamber. The fluid from one fluid reservoir then flows into the other fluid reservoir, so that the fluids can mix. Until the chemist squeezes the flexible walls of the one fluid reservoir, however, the compounds are kept separate.

Consequently, the present invention is not limited to the particular embodiments that are described in this Specification.

What is claimed is:

1. A spill-proof container for fluids comprising:

a bottle having a neck, flexible sides, and a fluid reservoir;

said neck having a first narrow portion, a relatively wider chamber portion adjacent to the first narrow portion, and a second narrow portion adjacent to said chamber;

a fluid flow path defined from said fluid reservoir through said first narrow portion, said relatively wider portion and said second narrow portion, said fluid flow path interconnecting said narrow portions and said wider portion;

a flexible plug that is compressed by and lodged within said first narrow portion to block the fluid flow path, said flexible plug comprising compressible material;

said flexible plug adapted to dislodge from said narrow portion into said chamber to open said fluid flow path when pressure is applied to said plug from within said fluid reservoir in response to a user squeezing the sides of the bottle.

2. A container as defined in claim 1, wherein said second narrow portion opens to the exterior of the bottle.

3. A container as defined in claim 1 further comprising a finger at said second narrow portion extending into said neck to retain said plug within said neck.

4. A spill-proof container for fluids comprising:

a neck;

a fluid reservoir having flexible sides;

said neck having a narrow portion and a relatively wider portion adjacent to the narrow portion, and a fluid flow path from said fluid reservoir through said narrow portion and through said relatively wider portion;

a plug having a compressible portion that is lodged in said narrow portion to block the fluid flow path;

said flexible plug adapted to dislodge from said narrow portion to said relatively wider portion to open said fluid flow path when pressure is applied to said plug from within said bottle in response to a user squeezing said flexible sides;

wherein said narrow portion is a first narrow portion, and wherein said bottle has a second narrow portion, said wider portion being in between the two said narrow portions, said second portion preventing the plug from exiting from the wider portion once the plug has been dislodged from the first narrow portion, said fluid flow path extending from said first narrow portion through said relatively wider portion and through said second narrow portion.

5. A container as defined in claim 4 wherein said flexible plug comprises a closed cell foam.

6. A container as defined in claim 4 wherein said bottle is filled with motor oil and said pressure is the pressure of the motor oil against the plug.

7. A container as defined in claim 4 wherein said narrow portion compresses a portion of said flexible material when said plug is lodged in said narrow portion.

8. A container as defined in claim 4, wherein said container further comprises a finger extending into said neck to retain said plug within said neck.

9. A method of dispensing a liquid comprising:

providing a container as defined in claim 4, said container having been at least partially filled with a liquid;

inverting the container such that said neck is generally below said fluid reservoir;

inserting at least a portion of the neck of the container into an opening into which the fluid is to flow;

after said step of inserting at least a portion of the neck into an opening, squeezing at least one flexible side of said fluid reservoir to place said liquid under pressure and to dislodge said plug from said first narrow portion of the neck and thereby opening said fluid flow path.

10. A spill-proof container for fluids comprising:

a neck and a fluid reservoir having flexible sides;

said neck having a narrow portion and a relatively wider portion adjacent to the narrow portion, and a fluid flow path from said fluid reservoir through said narrow portion and through said relatively wider portion;

a plug having a compressible portion that is lodged in said narrow portion to block the fluid flow path;

said flexible plug adapted to dislodge from said narrow portion to said relatively wider portion to open said fluid flow path when pressure is applied to said plug from within said bottle in response to a user squeezing said flexible sides;

wherein said relatively wider portion comprises a chamber.

11. A spill-proof container for fluids comprising:

a neck and a fluid reservoir having flexible sides;

said neck having a narrow portion and a relatively wider portion adjacent to the narrow portion, and a fluid flow path through said narrow portion and through said relatively wider portion;

a plug having a compressible portion that is lodged in said narrow portion to block the fluid flow path;

said flexible plug adapted to dislodge from said narrow portion to said relatively wider portion to open said fluid flow path when pressure is applied to said plug from within said bottle in response to a user squeezing said flexible sides;

wherein said container further comprises a finger extending into said neck to retain said plug within said neck.

12. A container as defined in claim 11 wherein said flexible plug comprises a closed cell foam.

13. A container as defined in claim 11 wherein said bottle is filled with motor oil and said pressure is the pressure of the motor oil against the plug.

14. A container as defined in claim 11 wherein said narrow portion compresses a portion of said flexible material when said plug is lodged in narrow portion.

15. A bottle for motor oil comprising:

a neck, a flexible portion, and a fluid reservoir filled at least partially with motor oil;

said neck having a narrow portion, and a fluid flow path from said fluid reservoir through said narrow portion;

a plug lodged in said narrow portion to block the fluid flow path;

said plug adapted to permanently dislodge from said narrow portion to open said fluid flow path when pressure is applied to said plug from within said bottle in response to a user squeezing said flexible portion;

wherein said bottle further comprises a chamber adjacent to said narrow portion, said narrow portion being located in between said fluid reservoir and said chamber, said chamber being larger than said plug.

* * * * *